US011170954B2

(12) United States Patent
Sugisawa et al.

(10) Patent No.: US 11,170,954 B2
(45) Date of Patent: Nov. 9, 2021

(54) INPUT APPARATUS

(71) Applicant: Alps Alpine Co., Ltd., Tokyo (JP)

(72) Inventors: Seiki Sugisawa, Miyagi-ken (JP); Takashi Sato, Miyagi-ken (JP)

(73) Assignee: Alps Alpine Co., Ltd.

( * ) Notice: Subject to any disclaimer, the term of this patent is extended or adjusted under 35 U.S.C. 154(b) by 0 days.

(21) Appl. No.: 16/916,819

(22) Filed: Jun. 30, 2020

(65) Prior Publication Data

US 2020/0328045 A1 Oct. 15, 2020

Related U.S. Application Data

(63) Continuation of application No. PCT/JP2018/039588, filed on Oct. 25, 2018.

(30) Foreign Application Priority Data

Jan. 10, 2018 (JP) ..... JP2018-002025

(51) Int. Cl.
*H01H 13/14* (2006.01)
*H01H 13/04* (2006.01)
*H01H 13/20* (2006.01)

(52) U.S. Cl.
CPC ..... *H01H 13/14* (2013.01); *H01H 13/04* (2013.01); *H01H 13/20* (2013.01)

(58) Field of Classification Search
CPC ..... H01H 13/14; H01H 13/04; H01H 13/20; H01H 13/84; H01H 2221/048; H01H 2221/04; H01H 2215/042; H01H 36/0073; H01H 13/50; H01H 13/52; H01H 13/85; H01H 2215/03; H01H 2221/062; H01H 13/62; H01H 13/64
See application file for complete search history.

(56) References Cited

U.S. PATENT DOCUMENTS

| | | | | |
|---|---|---|---|---|
| 3,815,066 A * | 6/1974 | Vinal | ..... | H03K 17/90 335/306 |
| 9,959,991 B2 * | 5/2018 | Chen | ..... | H01H 13/52 |
| 2015/0170853 A1 * | 6/2015 | Seo | ..... | H01H 13/04 200/521 |

FOREIGN PATENT DOCUMENTS

| | | |
|---|---|---|
| EP | 2891835 A1 | 7/2015 |
| EP | 3096198 A2 | 11/2016 |
| JP | 550-091662 U | 8/1975 |

(Continued)

*Primary Examiner* — Lheiren Mae A Caroc
(74) *Attorney, Agent, or Firm* — Harness, Dickey & Pierce, P.L.C.

(57) ABSTRACT

An input apparatus includes an operating member that receives an operating force, a casing holding the operating member so as to move in the vertical direction, a first switch and a second switch that switch between on-state and off-state as the operating member moves, a first magnetic substance attached to the casing, a second magnetic substance that moves together with the operating member, and a third magnetic substance disposed so as to come into contact with the first magnetic substance and the second magnetic substance when the operating member is not receiving an operating force and so as to come into contact with one of the first magnetic substance and the second magnetic substance when the operating member is receiving an operating force. At least one of the first magnetic substance, the second magnetic substance, and the third magnetic substance is a magnet.

5 Claims, 11 Drawing Sheets

(56) References Cited

FOREIGN PATENT DOCUMENTS

| | | | |
|---|---|---|---|
| JP | 2015-149058 | A | 8/2015 |
| JP | 2016-206787 | A | 12/2016 |
| JP | 2017-001570 | A | 1/2017 |
| JP | 2017-045608 | A | 3/2017 |

* cited by examiner

INPUT APPARATUS

CROSS REFERENCE TO RELATED APPLICATIONS

This application is a Continuation of International Application No. PCT/JP2018/039588 filed on Oct. 25, 2018, which claims benefit of Japanese Patent Application No. 2018-002025 filed on Jan. 10, 2018. The entire contents of each application noted above are hereby incorporated by reference.

BACKGROUND OF THE INVENTION

1. Field of the Invention

The present disclosure relates to input apparatuses.

2. Description of the Related Art

There is a known input apparatus in the related art that includes a slide member movable in the direction of pressing operation, a slide guide that guides the movement of the slide member, and a switch unit to be pressed by the slide member (see Japanese Unexamined Patent Application Publication No. 2017-045608). This input apparatus includes a first magnet attached to the slide member and a second magnet attached to the slide guide. The first magnet and the second magnet are disposed at positions at which they attract each other with a space therebetween when no pressing operation is being performed. This configuration allows the input apparatus to reduce or eliminate wobbling of the slide member when no pressing operation is being performed.

However, in the input apparatus, the first magnet and the second magnet are disposed away from each other all the time. For this reason, wobbling of the slide member serving as a movable member may not be eliminated.

It is therefore preferable to provide an input apparatus in which wobbling of the movable member is assuredly prevented.

SUMMARY OF THE INVENTION

The present disclosure provides an input apparatus including a movable member that receives an operating force, a fixing member that fixes the movable member so as to move in a plurality of operating directions, a switch that switches between on-state and off-state as the movable member moves, a first magnetic substance attached to the fixing member, a second magnetic substance that moves together with the movable member, and a third magnetic substance disposed so as to come into contact with each of the first magnetic substance and the second magnetic substance in a state in which the movable member is not receiving an operating force and so as to come into contact with one of the first magnetic substance and the second magnetic substance in a state in which the movable member is receiving an operating force, wherein at least one of the first magnetic substance, the second magnetic substance, and the third magnetic substance is a magnet.

BRIEF DESCRIPTION OF THE DRAWINGS

FIG. 10C1 is a diagram illustrating the state of a first magnetic substance, a second magnetic substance, and a third magnetic substance;

FIG. 10C2 is a diagram illustrating the state of the first magnetic substance, the second magnetic substance, and the third magnetic substance;

FIG. 10C3 is a diagram illustrating the state of the first magnetic substance, the second magnetic substance, and the third magnetic substance;

FIG. 11C1 is a diagram illustrating the state of the first magnetic substance, the second magnetic substance, and the third magnetic substance;

FIG. 11C2 is a diagram illustrating the state of the first magnetic substance, the second magnetic substance, and the third magnetic substance;

FIG. 11C3 is a diagram illustrating the state of the first magnetic substance, the second magnetic substance, and the third magnetic substance;

DESCRIPTION OF THE PREFERRED EMBODIMENTS

Figure 1A:
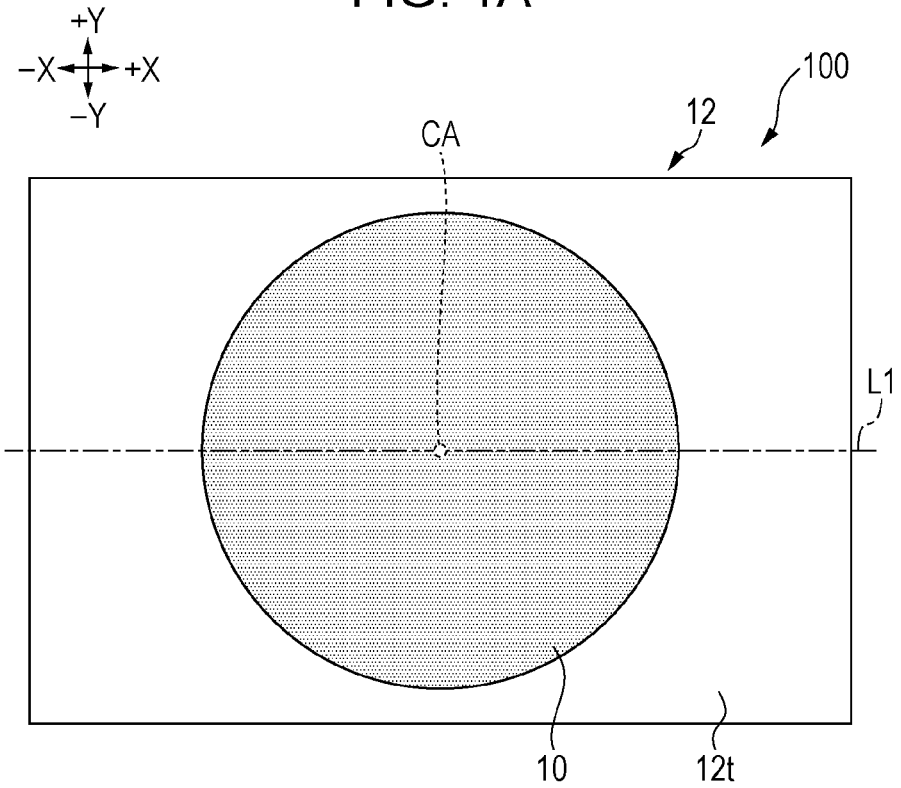
FIG. 1A is a top view of an input apparatus.
Figure 1B:
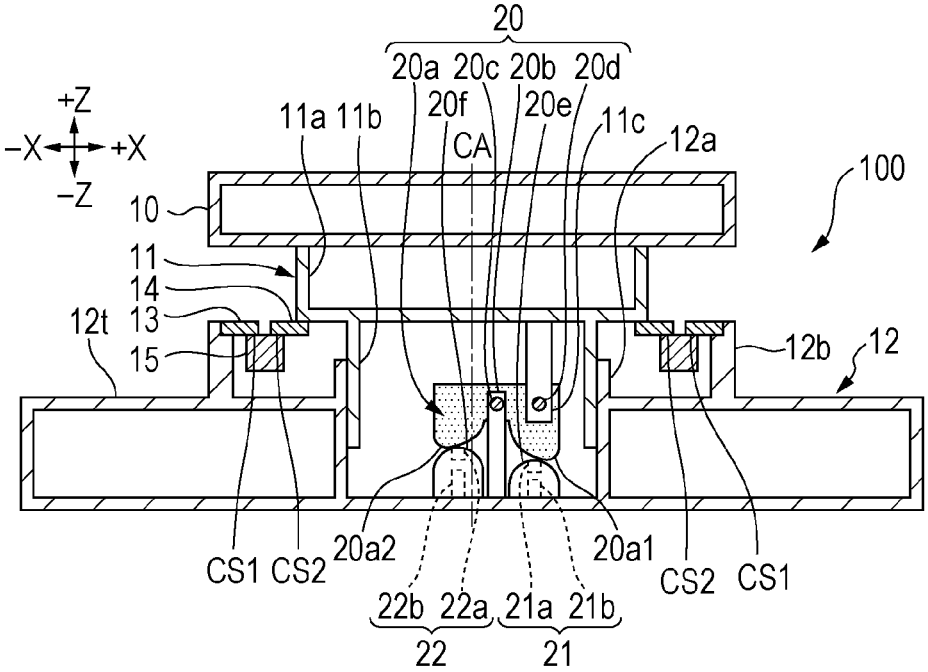
FIG. 1B is a cross-sectional view of the input apparatus.

An input apparatus 100 according to an embodiment of the present invention will be described hereinbelow with reference to the drawings. FIGS. 1A and 1B are schematic diagrams illustrating a configuration example of the input apparatus 100. Specifically, FIG. 1A is a top view of the input apparatus 100. FIG. 1B is a cross-sectional view of an X-Z plane including a dashed-dotted line L1 in FIG. 1A viewed from the −Y side.

The input apparatus 100 is configured to be operated in a plurality of operating directions. In the present embodiment, the input apparatus 100 is configured for the operator to perform an upward pulling operation (+Z direction) and a downward pushing operation (−Z direction). The input apparatus 100 is disposed, for example, in a center console of a vehicle, and is used for operating an air conditioner or the like.

Specifically, the input apparatus 100 mainly includes an operating member 10, a slide member 11, a casing 12, a first magnetic substance 13, a second magnetic substance 14, a third magnetic substance 15, a switch mechanism 20, a first switch 21, and a second switch 22. The input apparatus 100 is configured so that, when a pushing operation is performed, the first switch 21 is turned on, and when a pulling operation is performed, the second switch 22 is turned on.

The operating member 10 is part of a movable member, which is configured to receive an operating force. In the present embodiment, the operating member 10 has a cylindrical shape centered on an axis CA. The operating member 10 is configured for the operator to push the upper surface (+Z-side surface) and to pinch and pull up the cylindrical surface. Alternatively, the operating member 10 may have another shape, such as a polygonal columnar shape or an elliptic cylindrical shape. The operating member 10 is also configured, when a pushing operation is performed, to move to the lower limit position, when a pulling operation is performed, to move to the upper limit position, and when no pushing operation and no pulling operation are performed, to come to rest at the neutral position.

The slide member 11 is part of the movable member, which is configured to move according to the operating force. In the present embodiment, the slide member 11 includes a joint portion 11*a*, an engaging portion 11*b*, and a connecting portion 11*c* and is configured to slide in the direction of the pushing operation and the pulling operation, that is, in the Z-axis direction.

The joint portion 11*a* is configured to be joined to the operating member 10. In the present embodiment, the joint portion 11*a* is joined to the operating member 10 via a snap-fit configuration. Alternatively, the joint portion 11*a* may be joined to the operating member 10 via another joining structure or with an adhesive. The joint portion 11*a*, that is, the slide member 11, may be integral to the operating member 10.

The engaging portion 11*b* is configured to movably engage with the casing 12. In the present embodiment, the engaging portion 11*b* is configured to slidably engage with the inner wall surface of a cylindrical guide portion 12*a* formed inside the casing 12 in the operating direction (the Z-axis direction). Alternatively, the engaging portion 11*b* may be configured to slidably engage with the outer wall surface of the guide portion 12*a* in the operating direction.

The connecting portion 11*c* is configured to be connected to the switch mechanism 20. In the present embodiment, the connecting portion 11*c* is configured to operate the switch mechanism 20 so that, when a pushing operation is performed, the first switch 21 is turned on, and when a pulling operation is performed, the second switch 22 is turned on. Specifically, the connecting portion 11*c* includes two columnar members extending downward from the lower surface of the joint portion 11*a*. The details of the connection between the connecting portion 11*c* and the switch mechanism 20 will be described later.

The casing 12 is configured to function as a fixing member that holds the movable member so as to be movable in a plurality of operating directions. In the present embodiment, the casing 12 has a substantially rectangular parallelepiped shape and includes the guide portion 12*a* and a supporting portion 12*b*.

Figure 2:
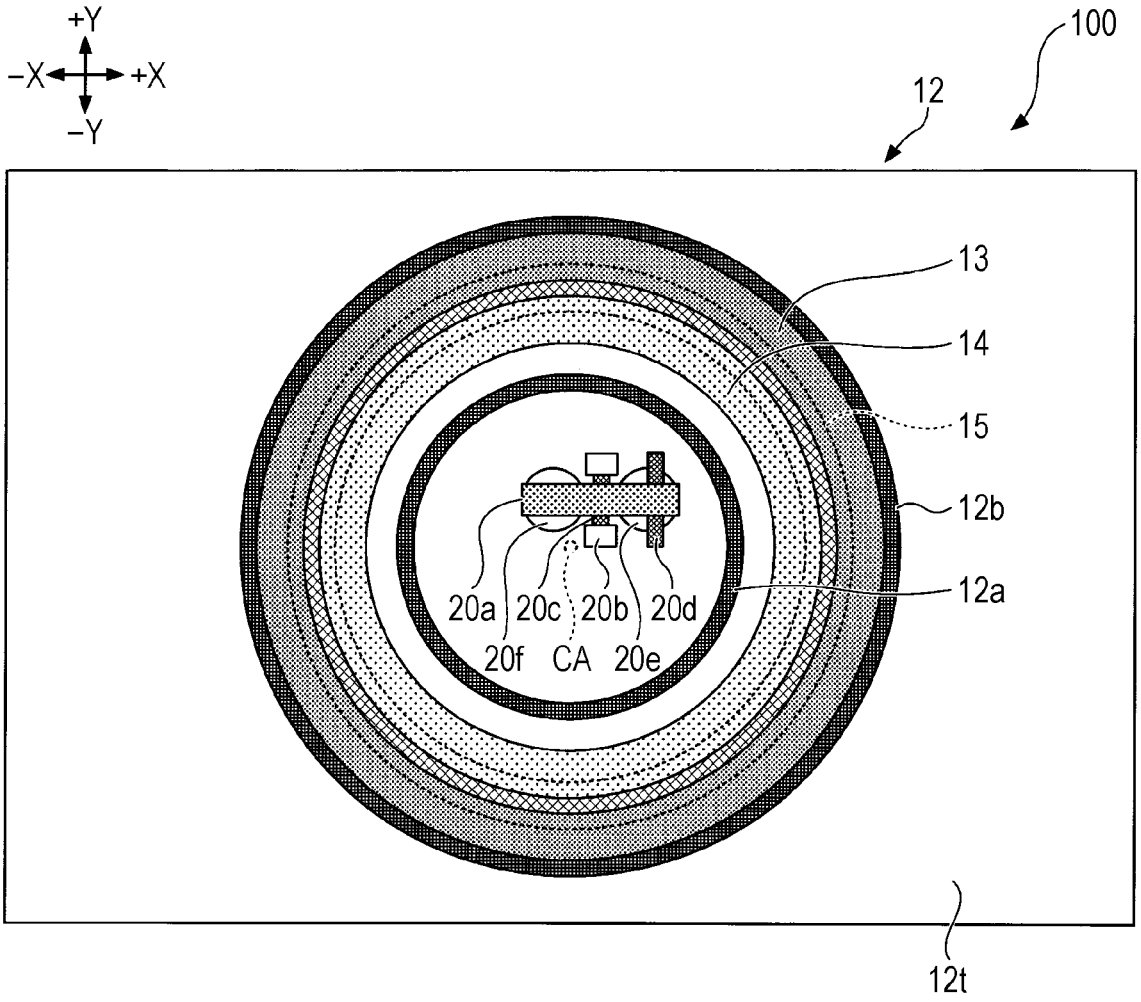
FIG. 2 is a top view of the input apparatus.

The guide portion 12*a* is configured to engage with the engaging portion 11*b* of the slide member 11, as described above. In the present embodiment, the guide portion 12*a* has a cylindrical shape centered on the axis CA, as illustrated in FIG. 2. FIG. 2 is a top view of the input apparatus 100 in FIG. 1A, in which the operating member 10 and the slide member 11 are omitted. However, the guide portion 12*a* may have any other shape that enables the guide portion 12*a* to engage with the engaging portion 11*b* of the slide member 11. For example, the guide portion 12*a* may have another cylindrical shape, such as a hollow square column shape. Other examples include a combination of a plurality of independent partial cylindrical shapes and a combination of a plurality of columnar shapes.

The guide portion 12*a* may be configured to prevent the engaging portion 11*b* of the slide member 11 from rotating about the axis CA. Specifically, the guide portion 12*a* may have a groove or a rib extending in the Z-axis direction along the cylindrical inner wall. In this case, the engaging portion 11*b* may have a rib or a groove formed so as to fit in the groove or on the rib of the guide portion 12*a*. Alternatively, the guide portion 12*a* may be configured so that the engaging portion 11*b* of the slide member 11 rotates about the axis CA.

The supporting portion 12*b* is configured to support the first magnetic substance 13. In the present embodiment, the supporting portion 12*b* is formed so as to protrude upward (in the +Z direction) from an upper surface 12*t* (a +Z side surface) of the casing 12 to support the first magnetic substance 13 at the upper end, as illustrated in FIG. 1B. Specifically, the supporting portion 12*b* has a cylindrical shape centered on the axis CA, as illustrated in FIG. 2. However, the supporting portion 12*b* may have any other shape that can support the first magnetic substance 13. For example, the supporting portion 12*b* may have another cylindrical shape, such as a hollow square column shape. Other examples include a combination of a plurality of independent partial cylindrical shapes and a combination of a plurality of columnar shapes.

The first magnetic substance 13 is a magnetic substance attached to the fixing member. In the present embodiment, the first magnetic substance 13 is a metallic magnetic substance. Specifically, the first magnetic substance 13 is a cylindrical iron plate centered on the axis CA, as illustrated in FIG. 2, and is fitted in a recess formed at the upper end of the supporting portion 12*b* of the casing 12, as illustrated in FIG. 1B. Alternatively, the first magnetic substance 13 may be fixed to the fixing member with an adhesive or using another fixing method. The first magnetic substance 13 may have another shape other than the cylindrical shape. The first magnetic substance 13 is made of a plate-like member having a through-hole. Alternatively, the first magnetic substance 13 may be made of a plate-like member having no through-hole.

The second magnetic substance 14 is a magnetic substance that moves together with the movable member. In the present embodiment, the second magnetic substance 14 is a metallic magnetic substance. Specifically, the second magnetic substance 14 is a cylindrical iron plate centered on the axis CA, as illustrated in FIG. 2, and is fixed to the joint portion 11*a* of the slide member 11 with an adhesive, as illustrated in FIG. 1B. Alternatively, the second magnetic substance 14 may be fitted in a recess formed in the movable member or may be fixed using another fixing method. The second magnetic substance 14 may have another shape other than the cylindrical shape. The second magnetic substance 14 is made of a plate-like member having a through-hole. Alternatively, the second magnetic substance 14 may be made of a plate-like member having no through-hole. In the present embodiment, the second magnetic substance 14 is disposed inside the through-hole of the first magnetic substance 13.

The third magnetic substance 15 is a magnetic substance that is disposed so as to be in contact with each of the first magnetic substance 13 and the second magnetic substance 14 in a state in which the movable member is receiving no operating force and to come into contact with one of the first magnetic substance 13 and the second magnetic substance 14 when the movable member receives an operating force. In the present embodiment, the third magnetic substance 15 is a magnet. Specifically, the third magnetic substance 15 is a cylindrical permanent magnet centered on the axis CA, as illustrated in FIG. 2, and is disposed so as to be attracted to the individual lower surfaces (−Z side surfaces) of the first magnetic substance 13 and the second magnetic substance 14, as illustrated in FIG. 1B. Alternatively, the third magnetic substance 15 may be a temporary magnet, such as an electromagnet. FIG. 1B illustrates a state in which the third magnetic substance 15 is attracted to each of the first magnetic substance 13 and the second magnetic substance 14 because the operating member 10 is not receiving an operating force, that is, wobbling of the operating member 10 and the slide member 11 serving as the movable member is not generated.

In the present embodiment, the third magnetic substance 15 is configured to move in both of the axial direction and the radial direction. Alternatively, the third magnetic substance 15 may be configured to be limited in radial movement. For example, the casing 12 may have a guide that restricts the radial movement of the third magnetic substance 15. This applies also to the axial direction.

The permanent magnet forming the third magnetic substance 15 is preferably magnetized in the vertical direction (in the Z-axis direction). The third magnetic substance 15 is magnetized and disposed so that, for example, the top is the north (N) pole, and the bottom is the south (S) pole, or the top is the S pole and the bottom is the N pole.

The contact surface CS1 between the first magnetic substance 13 and the third magnetic substance 15 and the contact surface CS2 between the second magnetic substance 14 and the third magnetic substance 15 are configured to be substantially flush with each other. Specifically, the contact surface CS1 and the contact surface CS2 are configured to be located on the same horizontal plane. However, the flush plane may be an inclined plane inclined with respect to the horizontal plane.

The contact surface CS1 and the contact surface CS2 are configured to be perpendicular to the moving direction of the movable member, in other words, configured so that the two magnetic substances come into contact with each other on one plane. This configuration can reduce or prevent rubbing of the two magnetic substances when the two magnetic substances come into or out of contact with each other. Alternatively, the contact surface CS1 and the contact surface CS2 may be configured so that the two magnetic substances rub against each other when coming into or out of contact with each other. For example, at least one of the contact surface CS1 and the contact surface CS2 may be configured to have a stepped portion, in other words, configured so that the two magnetic substances come into contact with each other on two surfaces. Specifically, the two magnetic substances may be configured to come into contact with each other on a surface perpendicular to the axis CA which is the moving direction of movable member and a surface parallel to the axis CA. In this case, the surface parallel to the axis CA may be a curved surface extending in the circumferential direction of the third magnetic substance 15, or a flat surface extending in the radial direction of the third magnetic substance 15.

An elastic member may be disposed between at least one of the first magnetic substance 13 and the second magnetic substance 14 and the third magnetic substance 15. The elastic member may be, for example, a magnetic substance or a non-magnetic substance having magnetic permeability. An example of the elastic member is an elastic sheet, which is disposed so as to form at least one of the contact surface CS1 and the contact surface CS2. The elastic sheet is bonded to, for example, at least one of the two relevant magnetic substances with an adhesive. At least one of the first magnetic substance 13, the second magnetic substance 14, and the third magnetic substance 15 may be formed of an elastic magnetic substance.

In the configuration of FIG. 1B, the first magnetic substance 13 and the second magnetic substance 14 may be magnets, and the third magnetic substance 15 may be a metallic magnetic substance, or all of the first magnetic substance 13, the second magnetic substance 14, and the third magnetic substance 15 may be magnets.

The switch mechanism 20 is configured to switch the switch between on-state and off-state according to the movement of the movable member. In the present embodiment, the switch mechanism 20 includes a switch actuator 20*a*, a supporting member 20*b*, a pivot shaft 20*c*, a connecting shaft 20*d*, a first dome-like member 20*e*, and a second dome-like member 20*f*.

The switch actuator 20*a* is a mechanism that switches the switch between on-state and off-state in conjunction with the movement of the movable member. In the present embodiment, the switch actuator 20*a* is configured to pivot about the pivot shaft 20*c* supported by the supporting member 20*b*. The switch actuator 20*a* includes a first protrusion 20*a*1 configured to push the first dome-like member 20*e* and a second protrusion 20*a*2 configured to push the second dome-like member 20*f*.

The supporting member 20*b* is configured to support the pivot shaft 20*c*. In the present embodiment, the supporting member 20*b* includes two columnar members extending upward from the bottom of the casing 12, as illustrated in FIG. 1B and FIG. 2.

The pivot shaft 20*c* is configured to pivotably support the switch actuator 20*a*. In the present embodiment, the pivot shaft 20*c* is passed through three through-holes formed in the switch actuator 20*a* and the two columnar members forming the supporting member 20*b*.

The connecting shaft 20*d* is configured to connect the switch actuator 20*a* to the slide member 11. In the present embodiment, the connecting shaft 20*d* is passed through three through-holes formed in the two columnar members forming the connecting portion 11*c* of the slide member 11 and the switch actuator 20*a*.

The first dome-like member 20*e* is configured to function as an urging member that returns the operating member 10 to its neutral position when the operating member 10 is pushed. In the present embodiment, the first dome-like member 20*e* is a rubber dome, which is configured to dent downward when the operating member 10 is pushed, so that the first protrusion 20*a*1 of the switch actuator 20*a* is brought into contact therewith. This allows the first dome-like member 20*e* to give a tactile feel to the operator when the first switch 21 switches from off-state to on-state. Furthermore, the dent portion of the first dome-like member 20*e* returns toward its original shape, thereby generating a restoring force that works to return the operating member 10 toward the neutral position. The first dome-like member 20*e* may be a metal dome.

The second dome-like member 20*f* is configured to function as an urging member that returns the operating member 10 to its neutral position when the operating member 10 is pulled. In the present embodiment, the second dome-like member 20*f* is a rubber dome, which is configured to dent downward when the operating member 10 is pulled, so that the second protrusion 20*a*2 of the switch actuator 20*a* is brought into contact therewith. This allows the second dome-like member 20*f* to give a tactile feel to the operator when the second switch 22 switches from off-state to on-state. Furthermore, the dent portion of the second dome-like member 20*f* returns toward its original shape, thereby generating a restoring force that works to return the operating member 10 toward the neutral position. The second dome-like member 20*f* may be a metal dome.

The first switch 21 is configured to switch between on-state and off-state with the movement of the movable member. In the present embodiment, the first switch 21 is a tactile switch including a movable contact 21*a* and a fixed contact 21*b*, as illustrated in FIG. 1B. The first switch 21 enters off-state when the operating member 10 is not receiving an operating force, that is, in a state in which the movable contact 21*a* and the fixed contact 21*b* are spaced apart. When the operating member 10 receives a pushing force, the first switch 21 enters on-state, that is, a state in which the movable contact 21*a* and the fixed contact 21*b* are in contact.

Like the first switch 21, the second switch 22 is configured to switch between on-state and off-state with the movement of the movable member. In the present embodiment, the second switch 22 is a tactile switch including a movable contact 22*a* and a fixed contact 22*b*, as illustrated in FIG. 1B. The second switch 22 enters off-state when the operating member 10 is not receiving an operating force, that is, in a state in which the movable contact 22*a* and the fixed contact 22*b* are spaced apart. When the operating member 10 receives a pulling force, the second switch 22 enters on-state, that is, a state in which the movable contact 22*a* and the fixed contact 22*b* are in contact.

Figure 3:
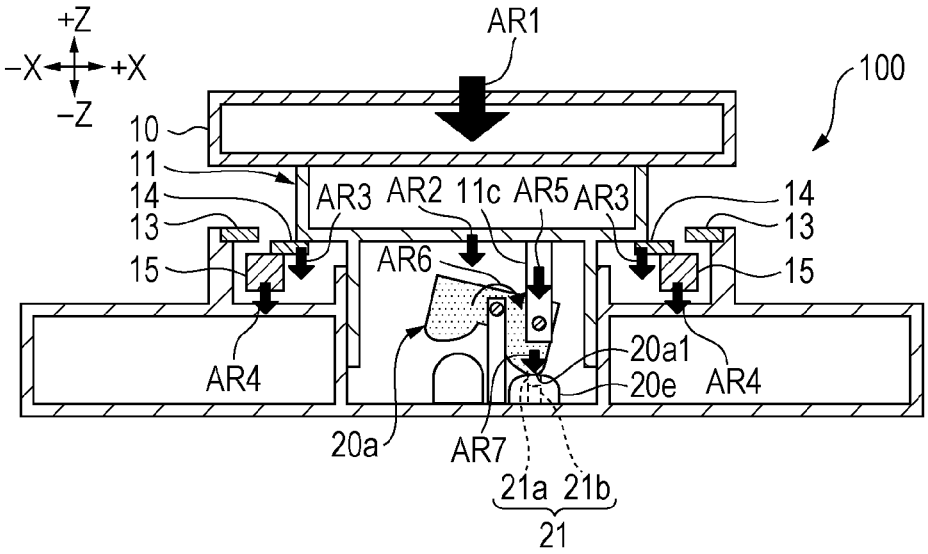
FIG. 3 is a cross-sectional view of the input apparatus when a pushing operation is performed.

Referring next to FIG. 3, the operation of the input apparatus 100 when the operating member 10 has received a pushing force will be described. FIG. 3 is a cross-sectional view of the input apparatus 100 when a pushing operation is performed.

When the operating member 10 receives a pushing force as indicated by arrow AR1 in FIG. 3, the slide member 11 moves downward as indicated by arrow AR2. This causes the second magnetic substance 14 attached to the slide member 11 to move downward, as indicated by arrow AR3, and also the third magnetic substance 15 attracted to the second magnetic substance 14 to move downward as indicated by arrow AR4. As a result, the third magnetic substance 15 moves downward away from the first magnetic substance 13 while remaining attracted to the second magnetic substance 14.

The connecting portion 11*c* of the slide member 11 moves downward together with the downward movement of the slide member 11, as indicated by arrow AR5, to pivot the switch actuator 20*a* in the direction of arrow AR6.

The first protrusion 20*a*1 of the switch actuator 20*a* presses down the first dome-like member 20*e*, as indicated by arrow AR7, to bring the movable contact 21*a* and the fixed contact 21*b* into contact with each other to bring the first switch 21 to on-state.

The pressed first dome-like member 20*e* generates an upward restoring force, that is, a force that returns the operating member 10 serving as the movable member toward the neutral position. For this reason, when the operator moves his/her hand off the operating member 10, the operating member 10 moves upward back to the neutral position.

Figure 4:
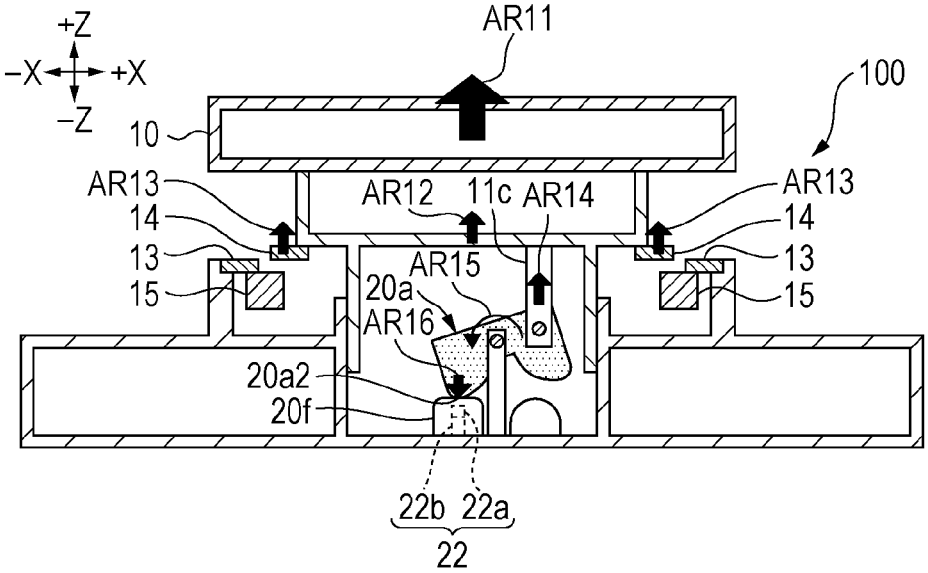
FIG. 4 is a cross-sectional view of the input apparatus when a pulling operation is performed.

Referring next to FIG. 4, the operation of the input apparatus 100 when the operating member 10 receives a pulling force will be described. FIG. 4 is a cross-sectional view of the input apparatus 100 when a pulling operation is performed.

When the operating member 10 receives a pulling force as indicated by arrow AR11 in FIG. 4, the slide member 11 moves upward as indicated by arrow AR12. This causes the second magnetic substance 14 attached to the slide member 11 to move upward away from the third magnetic substance 15, as indicated by arrow AR13. The third magnetic substance 15 does not move while remaining attracted to the first magnetic substance 13.

The connecting portion 11*c* of the slide member 11 moves upward together with the upward movement of the slide member 11, as indicated by arrow AR14, to pivot the switch actuator 20*a* in the direction indicated by arrow AR15.

The second protrusion 20*a*2 of the switch actuator 20*a* presses down the second dome-like member 20*f*, as indicated by arrow AR16, to bring the movable contact 22*a* and the fixed contact 22*b* into contact with each other to bring the second switch 22 to on-state.

The pressed second dome-like member 20*f* generates an upward restoring force, that is, a force that returns the operating member 10 serving as the movable member toward the neutral position. For this reason, when the operator moves his/her hand off the operating member 10, the operating member 10 moves downward back to the neutral position.

The above configuration allows the input apparatus 100 to bring the first switch 21 to on-state when a pushing operation is performed and to bring the second switch 22 to on-state when a pulling operation is performed. On that basis, when neither of the pushing operation and the pulling operation is performed, the input apparatus 100 brings the first switch 21 and the second switch 22 to off-state and makes the third magnetic substance 15 attracted to each of the first magnetic substance 13 and the second magnetic substance 14 to prevent or reduce wobbling of the movable member more assuredly.

Furthermore, the input apparatus 100 is configured to assuredly prevent or reduce wobbling of the movable member at the neutral position by using a magnet only for the third magnetic substance 15. This can reduce the manufacturing cost as compared with a case in which two or more of the first magnetic substance 13, the second magnetic substance 14, and the third magnetic substance 15 are magnets.

Figure 5A:
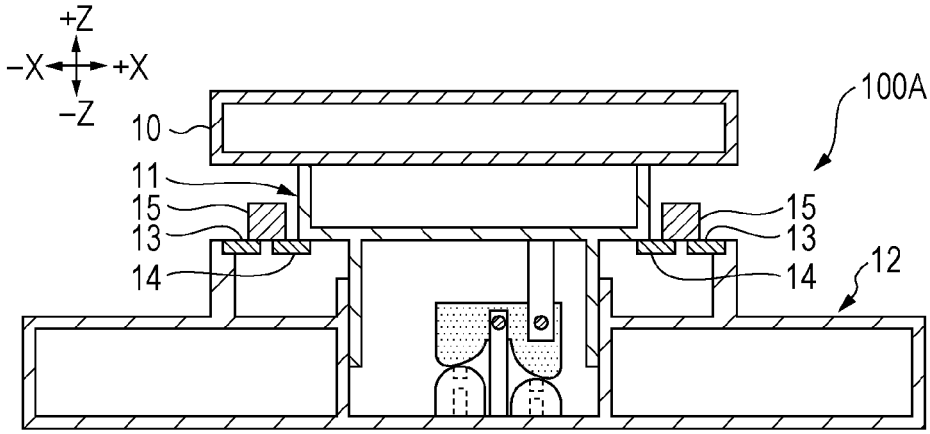
FIG. 5A is a cross-sectional view of another configuration example of the input apparatus.
Figure 5B:
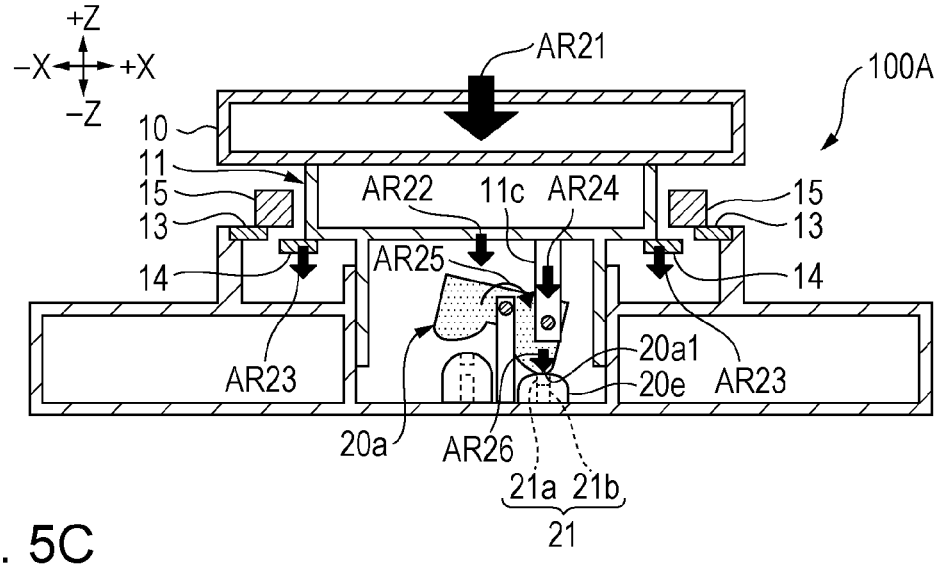
FIG. 5B is a cross-sectional view of the input apparatus in FIG. 5A when a pushing operation is performed.
Figure 5C:
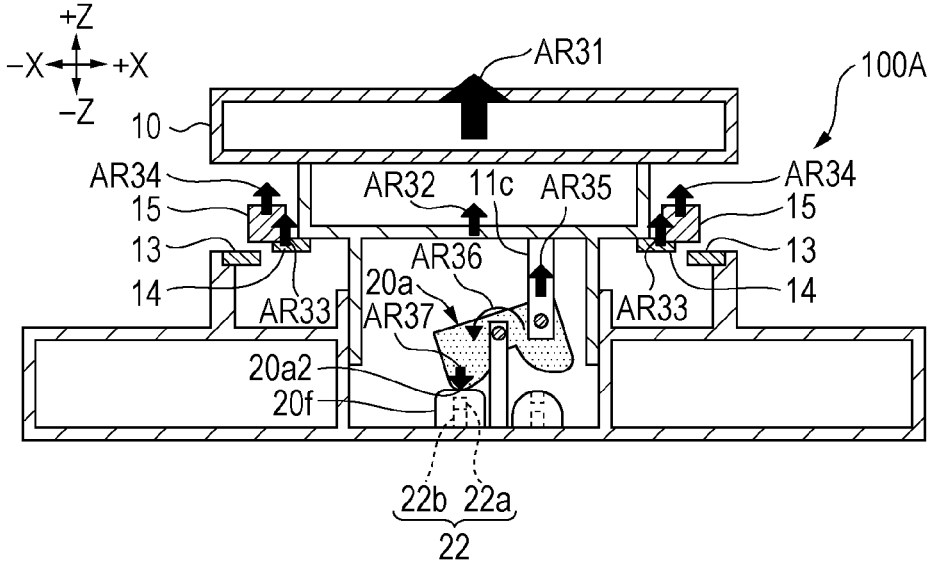
FIG. 5C is a cross-sectional view of the input apparatus in FIG. 5A when a pulling operation is performed.

Referring next to FIGS. 5A to 5C, an input apparatus 100A, which is another configuration example of the input apparatus 100, will be described. FIGS. 5A to 5C are diagrams illustrating a configuration example of the input apparatus 100A. Specifically, FIG. 5A illustrates a state in which neither a pressing operation nor a pulling operation is performed, which corresponds to FIG. 1B. FIG. 5B illustrates a state in which a pressing operation is performed, which corresponds to FIG. 3. FIG. 5C illustrates a state in which a pulling operation is performed, which corresponds to FIG. 4.

The input apparatus 100A differs from the input apparatus 100 in that the third magnetic substance 15 is disposed so as to be attracted to the upper surface (+Z side surface) of each of the first magnetic substance 13 and the second magnetic substance 14, but is in common in the others. For this reason, descriptions of the points in common will be omitted, and only the difference will be described in detail. The input apparatus 100 is configured so that the third magnetic substance 15 can be attracted to the lower surface (−Z side surface) of each of the first magnetic substance 13 and the second magnetic substance 14, as illustrated in FIG. 1B.

For the input apparatus 100A, it is only required that at least one of the first magnetic substance 13, the second magnetic substance 14, and the third magnetic substance 15 is a magnet. For example, the first magnetic substance 13 may be a magnet, and the second magnetic substance 14 and the third magnetic substance 15 may be metallic magnetic substances, or alternatively, the second magnetic substance 14 may be a magnet, and the first magnetic substance 13 and the third magnetic substance 15 may be metallic magnetic substances. In still another alternative, the first magnetic substance 13 and the second magnetic substance 14 may be magnets, and the third magnetic substance 15 may be a metallic magnetic substance, or alternatively, all of the first magnetic substance 13, the second magnetic substance 14, and the third magnetic substance 15 may be magnets.

First, referring to FIG. 5B, the operation of the input apparatus 100A when the operating member 10 has received a pushing force will be described. FIG. 5B is a cross-sectional view of the input apparatus 100A when a pushing operation is performed.

When the operating member 10 receives a pushing force as indicated by arrow AR21 in FIG. 5B, the slide member 11 moves downward as indicated by arrow AR22. This causes the second magnetic substance 14 attached to the slide member 11 to move downward away from the third magnetic substance 15, as indicated by arrow AR23. The third magnetic substance 15 does move while remaining attracted to the first magnetic substance 13.

The connecting portion 11*c* of the slide member 11 moves downward together with the downward movement of the slide member 11, as indicated by arrow AR24, to pivot the switch actuator 20*a* in the direction of arrow AR25.

The first protrusion 20*a*1 of the switch actuator 20*a* presses down the first dome-like member 20*e*, as indicated by arrow AR26, to bring the movable contact 21*a* and the fixed contact 21*b* into contact with each other to bring the first switch 21 to on-state.

The pressed first dome-like member 20*e* generates an upward restoring force, that is, a force that returns the operating member 10 serving as the movable member toward the neutral position. For this reason, when the operator moves his/her hand off the operating member 10, the operating member 10 moves upward back to the neutral position.

Referring next to FIG. 5C, the operation of the input apparatus 100A when the operating member 10 receives a pulling force will be described. FIG. 5C is a cross-sectional view of the input apparatus 100A when a pulling operation is performed.

When the operating member 10 receives a pulling force as indicated by arrow AR31 in FIG. 5C, the slide member 11 moves upward as indicated by arrow AR32. This causes the second magnetic substance 14 attached to the slide member 11 to move upward, as indicated by arrow AR33, and also the third magnetic substance 15 attracted to the second magnetic substance 14 to move upward, as indicated by arrow AR34. As a result, the third magnetic substance 15 moves upward away from the first magnetic substance 13 while remaining attracted to the second magnetic substance 14.

The connecting portion 11*c* of the slide member 11 moves upward together with the upward movement of the slide member 11, as indicated by arrow AR35, to pivot the switch actuator 20*a* in the direction of arrow AR36.

The second protrusion 20*a*2 of the switch actuator 20*a* presses down the second dome-like member 20*f*, as indicated by arrow AR37, to bring the movable contact 22*a* and the fixed contact 22*b* into contact with each other to bring the second switch 22 to on-state.

The pressed second dome-like member 20*f* generates an upward restoring force, that is, a force that returns the operating member 10 serving as the movable member toward the neutral position. For this reason, when the operator moves his/her hand off the operating member 10, the operating member 10 moves downward back to the neutral position.

The above configuration allows the input apparatus 100A to bring the first switch 21 to on-state when a pushing operation is performed and to bring the second switch 22 to on-state when a pulling operation is performed, like the input apparatus 100. On that basis, when neither of the pushing operation and the pulling operation is performed, the input apparatus 100A brings the first switch 21 and the second switch 22 to off-state and makes the third magnetic substance 15 attracted to each of the first magnetic substance 13 and the second magnetic substance 14 to prevent or reduce wobbling of the movable member more assuredly.

Referring next to FIGS. 6 to 9, input apparatuses 100B to 100E, which are still other configuration examples of the input apparatus 100, will be described. FIGS. 6 to 9 are top views of the input apparatuses 100B to 100E, respectively, which correspond to FIG. 2. In FIGS. 6 to 9, the illustrations of the operating member 10 and the switch mechanism 20 are omitted.

The input apparatuses 100B to 100E differ from the input apparatus 100 in FIG. 2 in the shapes of the first magnetic substance 13, the second magnetic substance 14, and the third magnetic substance 15, but in common in the others. For this reason, descriptions of the common parts will be omitted, and only the differences will be described in detail. The features related to the shapes of the magnetic substances illustrated in FIGS. 6 to 9 are also applicable to the input apparatus 100A in FIG. 5A.

Figure 6:
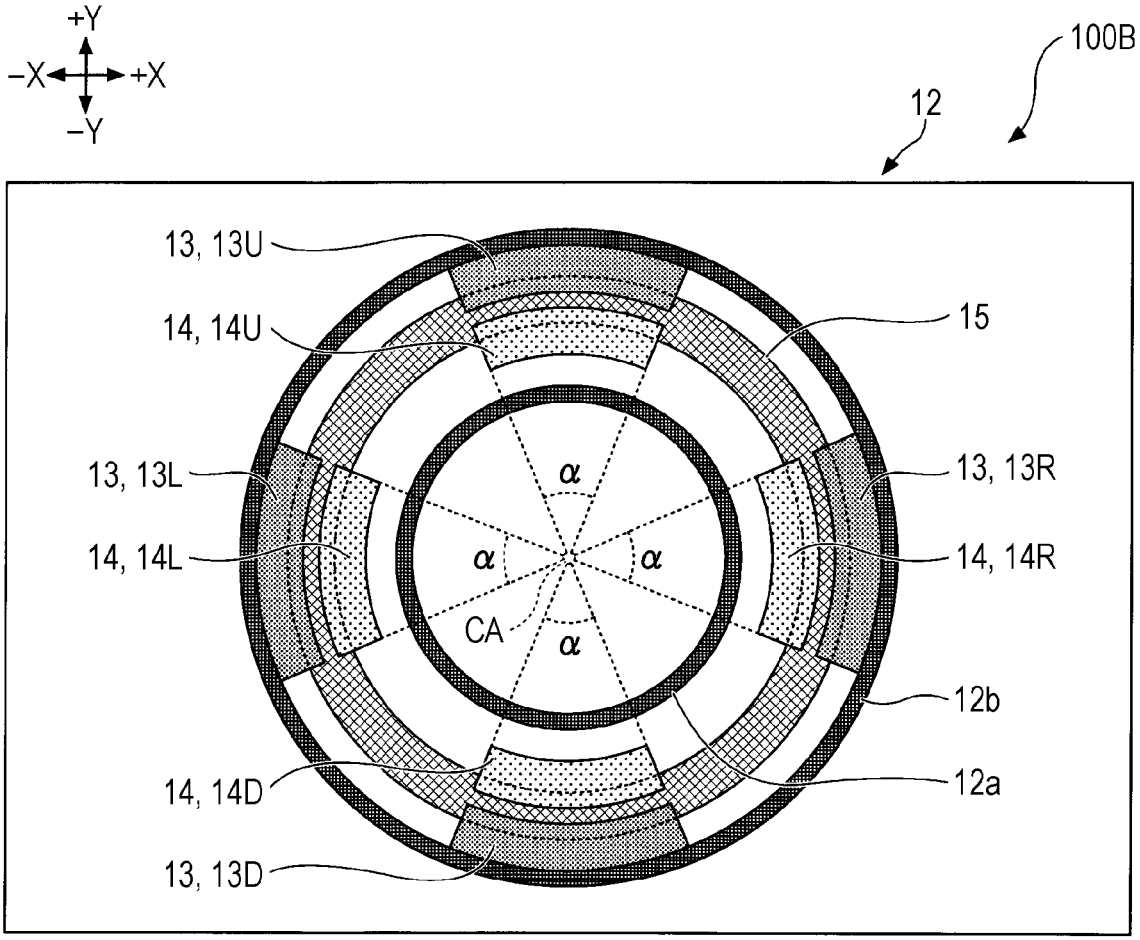
FIG. 6 is a diagram illustrating still another configuration example of the input apparatus.

In the input apparatus 100B of FIG. 6, each of the first magnetic substance 13 and the second magnetic substance 14 is formed of four members. The third magnetic substance 15 has a cylindrical shape, as in the case of the input apparatus 100. Specifically, the first magnetic substance 13 includes a first left magnetic substance 13L, a first upper magnetic substance 13U, a first right magnetic substance 13R, and a first lower magnetic substance 13D arranged at regular angular intervals (for example, at intervals of 45 degrees) about the axis CA. Likewise, the second magnetic substance 14 includes a second left magnetic substance 14L, a second upper magnetic substance 14U, a second right magnetic substance 14R, and a second lower magnetic substance 14D arranged at regular angular intervals (for example, at intervals of 45 degrees) about the axis CA. These eight magnetic substances have a partial cylindrical shape with a central angle $\alpha$ (for example, 45 degrees). However, the central angles of the magnetic substances may differ from one another. For example, the central angle of the first left magnetic substance 13L may be larger than the central angle of the second left magnetic substance 14L.

The input apparatus 100B may be configured such that each of the first magnetic substance 13 and the second magnetic substance 14 is formed of a single member having a partial cylindrical shape, or two, three, or five or more members having a partial cylindrical shape. The central angles α of the magnetic substances may differ from one another. The angular intervals of the magnetic substances may differ from one another.

This configuration allows the input apparatus 100B to implement the same function as the function of the input apparatus 100 using the first magnetic substance 13 and the second magnetic substance 14 smaller than those of the input apparatus 100. This can further reduce the manufacturing cost.

Figure 7:
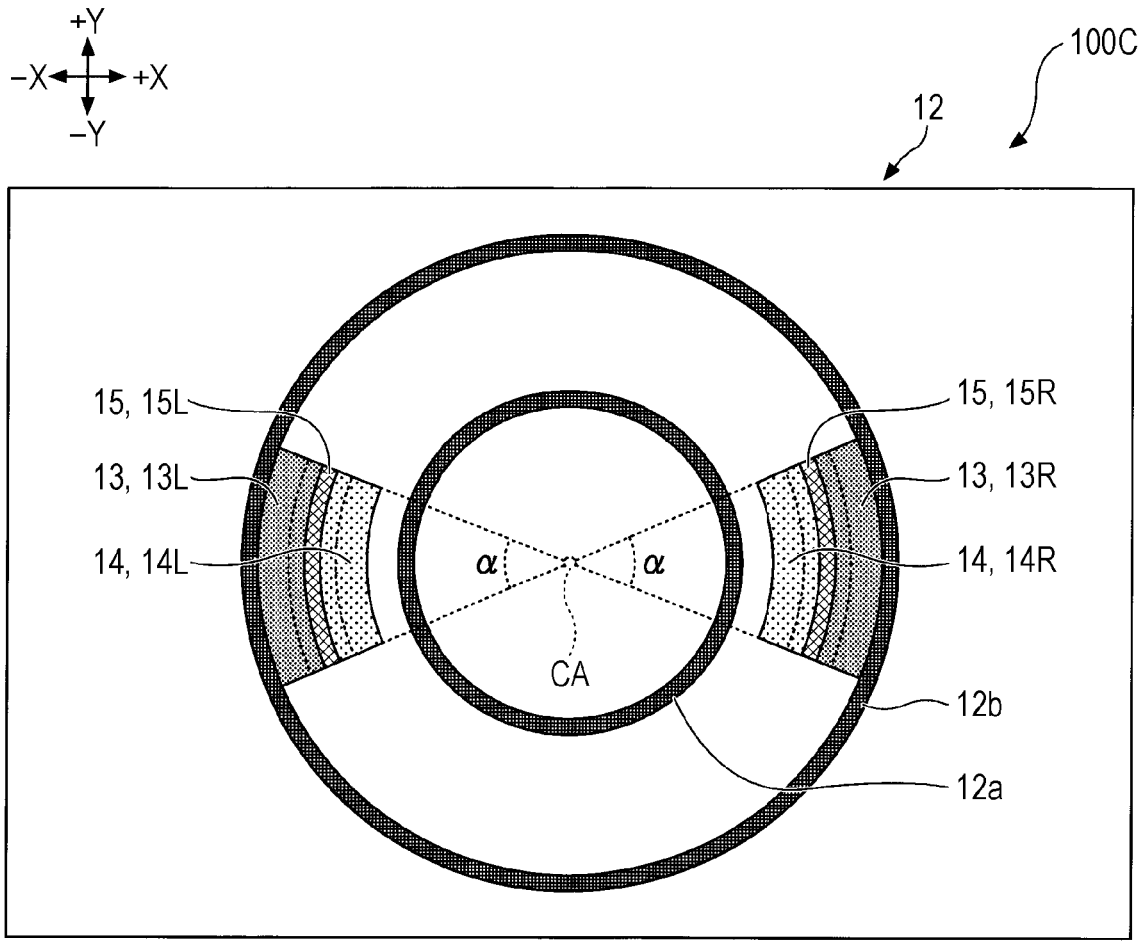
FIG. 7 is a diagram illustrating still another configuration example of the input apparatus.

The input apparatus 100C in FIG. 7 is configured such that each of the first magnetic substance 13, the second magnetic substance 14, and the third magnetic substance 15 is formed of two members. Specifically, the first magnetic substance 13 includes a first left magnetic substance 13L and a first right magnetic substance 13R disposed symmetrically about the axis CA, the second magnetic substance 14 includes a second left magnetic substance 14L and a second right magnetic substance 14R disposed symmetrically about the axis CA, and the third magnetic substance 15 includes a third left magnetic substance 15L and a third right magnetic substance 15R disposed symmetrically about the axis CA. All of the six magnetic substances have a partial cylindrical shape with a central angle α (for example, 45 degrees).

The input apparatus 100C may be configured such that each of the first magnetic substance 13, the second magnetic substance 14, and the third magnetic substance 15 is formed of a single member having a partial cylindrical shape, or three or more members having a partial cylindrical shape. The central angles α of the magnetic substances may differ from one another. The angular intervals of the magnetic substances may differ from one another.

This configuration allows the input apparatus 100C to implement the same function as the function of the input apparatus 100 using the third magnetic substance 15 smaller than the third magnetic substance 15 of the input apparatus 100B. This can further reduce the manufacturing cost.

Figure 8:
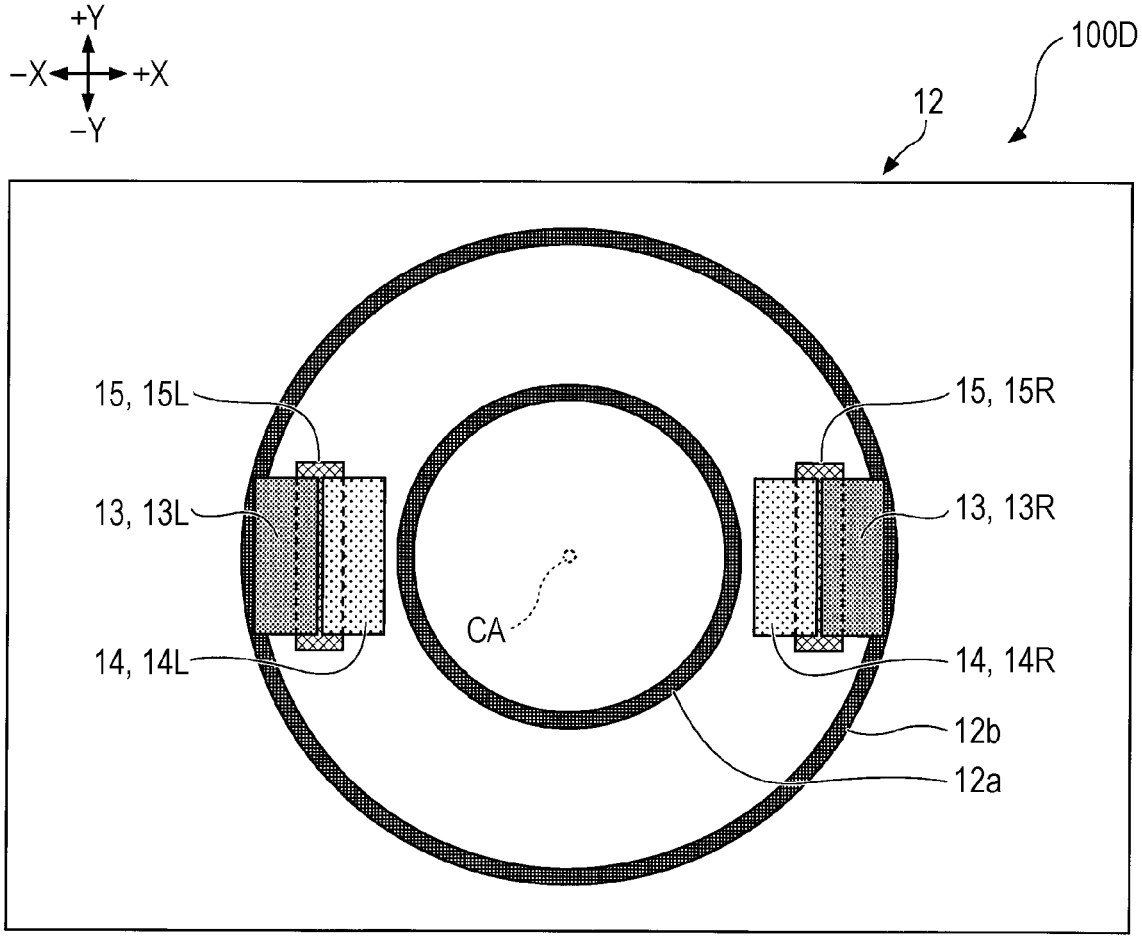
FIG. 8 is a diagram illustrating still another configuration example of the input apparatus.

The input apparatus 100D in FIG. 8 is configured such that each of the first magnetic substance 13, the second magnetic substance 14, and the third magnetic substance 15 is formed of two rectangular members. Specifically, the first magnetic substance 13 includes a first left magnetic substance 13L and a first right magnetic substance 13R arranged symmetrically about the axis CA, the second magnetic substance 14 includes a second left magnetic substance 14L and a second right magnetic substance 14R arranged symmetrically about the axis CA, and the third magnetic substance 15 includes a third left magnetic substance 15L and a third right magnetic substance 15R arranged symmetrically about the axis CA. All of the six magnetic substances have a rectangular shape. The first left magnetic substance 13L, the first right magnetic substance 13R, the second left magnetic substance 14L, and the second right magnetic substance 14R have the same size. The third left magnetic substance 15L and the third left magnetic substance 15L have the same size. The six magnetic substances may have the same size. The six magnetic substances may differ in at least one of the width (the length in the X-axis direction), the height (the length in the Z-axis direction), and the depth (the length in the Y-axis direction).

This configuration allows the input apparatus 100D to implement the same function as the function of the input apparatus 100 using the magnetic substances having a simpler shape than the cylindrical shape or the partial cylindrical shape. The use of the first magnetic substance 13, the second magnetic substance 14, and the third magnetic substance 15 having the same rectangular shape provides the same function as the function of the input apparatus 100. This can further reduce the manufacturing cost.

Figure 9:
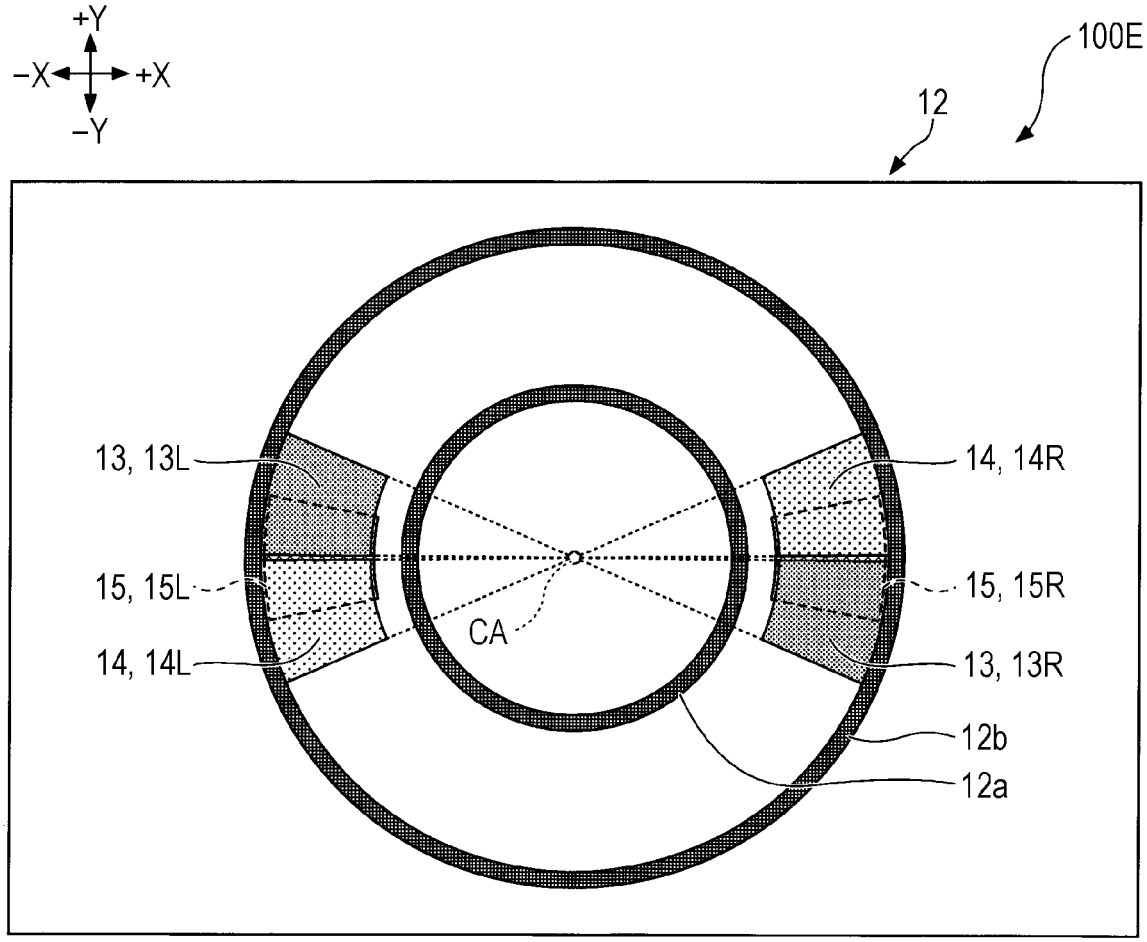
FIG. 9 is a diagram illustrating still another configuration example of the input apparatus.

The input apparatus 100E in FIG. 9 is configured such that each of the first magnetic substance 13, the second magnetic substance 14, and the third magnetic substance 15 is formed of two members. Specifically, the first magnetic substance 13 includes a first left magnetic substance 13L and a first right magnetic substance 13R arranged symmetrically about the axis CA. The second magnetic substance 14 includes a second left magnetic substance 14L and a second right magnetic substance 14R arranged symmetrically about the axis CA. The third magnetic substance 15 includes a third left magnetic substance 15L and a third right magnetic substance 15R arranged symmetrically about the axis CA. The six magnetic substances have a partial cylindrical shape and have the same size.

This configuration allows the input apparatus 100E to implement the same function as the function of the input apparatus 100 using the first magnetic substance 13, the second magnetic substance 14, and the third magnetic substance 15 having the same partial cylindrical shape and the same size. This can further reduce the manufacturing cost. The third magnetic substance 15 may be formed of a plurality of rectangular members or a single cylindrical member.

Figure 10A:
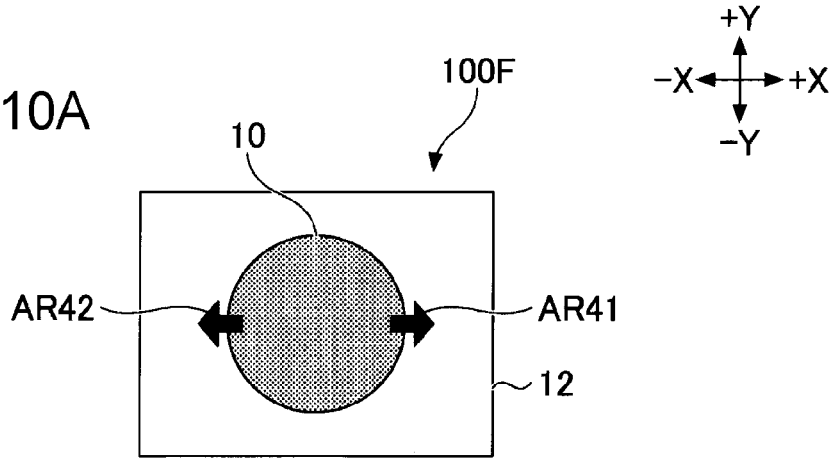
FIG. 10A is a top view of still another configuration example of the input apparatus.
Figure 10B:
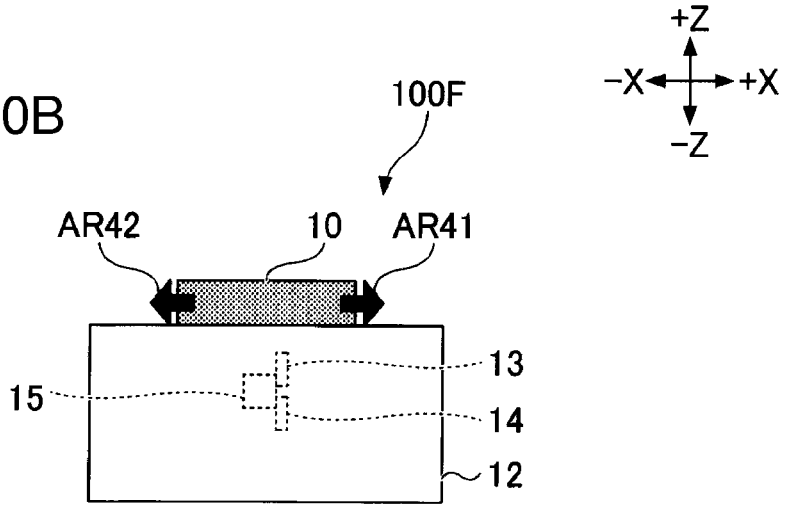
FIG. 10B is a front view of the input apparatus in FIG. 10A.
Figure 10B:
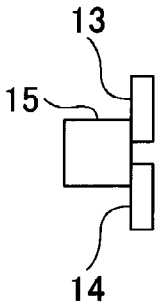
Figure 10B:
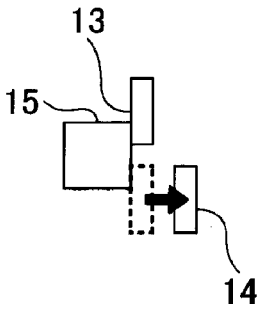
Figure 10B:
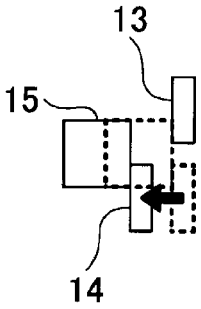

Referring next to FIGS. 10A and 10B and FIGS. 10C1 to 10C3, an input apparatus 100F, which is still another configuration example of the input apparatus 100, will be described. FIG. 10A is a top view of the input apparatus 100F, and FIG. 10B is a front view of the input apparatus 100F.

The input apparatus 100F differs from the input apparatus 100 in FIG. 1B, which is configured to be operated in a plurality of operating directions along the vertical axis, in that the input apparatus 100F can be operated in a plurality of operating directions along a horizontal plane. Specifically, the input apparatus 100F is configured so that the operator can perform a rightward pushing operation (+X direction) and a leftward pushing operation (−X direction).

FIG. 10C1 illustrates the state of the three magnetic substances (the first magnetic substance 13, the second magnetic substance 14, and the third magnetic substance 15) while the operating member 10 is not receiving an operating force. FIG. 10C2 illustrates the state of the three magnetic substances while the operating member 10 is receiving a rightward operating force (in the direction indicated by arrow AR41). FIG. 10C3 illustrates the state of the three magnetic substances while the operating member 10 is receiving a leftward operating force (in the direction indicated by arrow AR42). The broken lines in FIG. 10C2 and FIG. 10C3 indicate the positions of the magnetic substances while the operating member 10 is not receiving an operating force, in other words, while the operating member 10 is at the neutral position. In the examples of FIGS. 10A and 10B and FIGS. 10C1 to 10C3, the first magnetic substance 13 and the second magnetic substance 14 are iron plates, and the third magnetic substance 15 is a permanent magnet. Alternatively, the third magnetic substance 15 may be a temporary magnet, such as an electromagnet.

When the operating member 10 is not receiving an operating force, the third magnetic substance 15 is attracted to each of the first magnetic substance 13 and the second magnetic substance 14, as illustrated in FIG. 10C1.

When the operating member 10 receives a rightward operating force (indicated by arrow AR41), the second magnetic substance 14 attached to the operating member 10 serving as the movable member is separated from the third magnetic substance 15 to move rightward together with the operating member 10, as illustrated in FIG. 10C2. The third magnetic substance 15 does not move while remaining attracted to the first magnetic substance 13 attached to the casing 12 serving as the fixing member.

When the operating member 10 receives a leftward operating force (indicated by arrow AR42), the second magnetic substance 14 moves leftward together with the operating member 10 to push the third magnetic substance 15 to move leftward, as illustrated in FIG. 10C3. As a result, the third magnetic substance 15 is separated from the first magnetic substance 13 to move leftward together with the second magnetic substance 14.

Thus, even if the operating member 10 is operated not in the vertical direction but in the lateral direction, the input apparatus 100F can implement the same function as the function of the input apparatus 100 using the three magnetic substances. In other word, when a rightward pushing operation is performed, the first switch (not illustrated) can be brought to on-state, and when a leftward pushing operation is performed, the second switch (not illustrated) can be brought to on-state. On that basis, when neither the rightward pushing operation nor the leftward pushing operation is performed, the input apparatus 100F brings the first switch and the second switch to off-state, and makes the third magnetic substance 15 attracted to each of the first magnetic substance 13 and the second magnetic substance 14, thereby preventing or reducing wobbling of the movable member more assuredly.

Figure 11A:
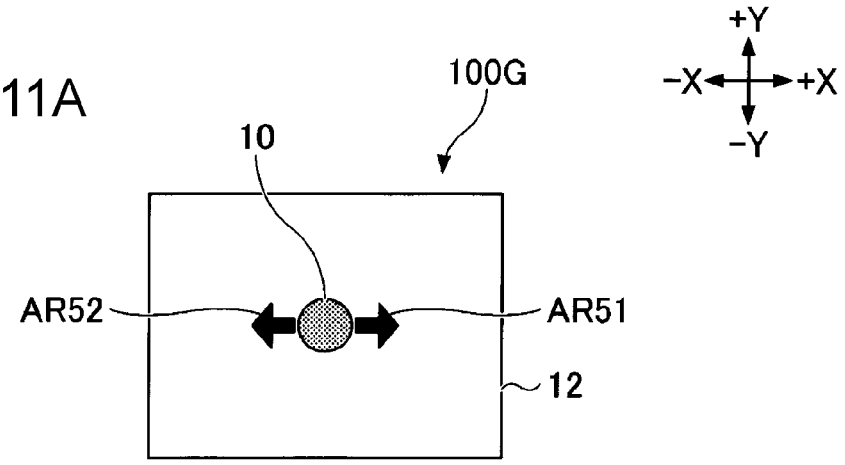
FIG. 11A is a top view of still another configuration example of the input apparatus.
Figure 11B:
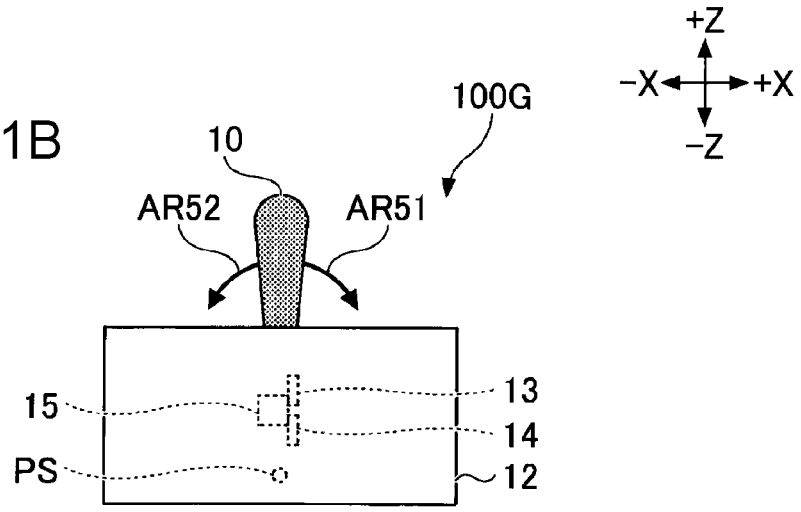
FIG. 11B is a front view of the input apparatus in FIG. 11A.
Figure 11B:
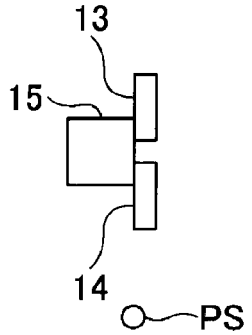
Figure 11B:
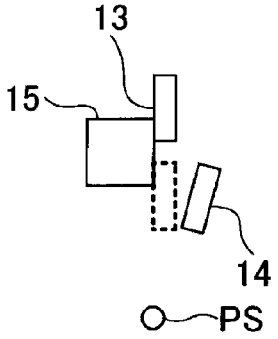
Figure 11B:
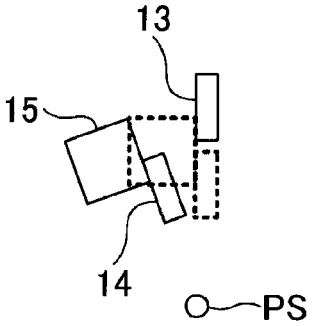

Referring next to FIGS. 11A and 11B and FIGS. 11C1 to 11C3, an input apparatus 100G, which is still another configuration example of the input apparatus 100, will be described. FIG. 11A is a top view of the input apparatus 100G, and FIG. 11B is a front view of the input apparatus 100G.

The input apparatus 100G mainly differs from the input apparatus 100 in FIG. 1B, which is configured to operate the operating member 10 in a plurality of operating directions along the vertical axis, in that the operating member 10 can be pivoted about a pivot shaft PS in a plurality of directions. Specifically, the input apparatus 100G is configured so that the operator can perform a clockwise pivoting operation and a counterclockwise pivoting operation.

FIG. 11C1 illustrates the state of the three magnetic substances (the first magnetic substance 13, the second magnetic substance 14, and the third magnetic substance 15) while the operating member 10 is not receiving an operating force. FIG. 11C2 illustrates the state of the three magnetic substances while the operating member 10 is receiving a clockwise operating force (in the direction indicated by arrow AR51). FIG. 11C3 illustrates the state of the three magnetic substances while the operating member 10 is receiving a counterclockwise operating force (in the direction indicated by arrow AR52). The broken lines in FIG. 11C2 and FIG. 11C3 indicate the positions of the magnetic substances while the operating member 10 is not receiving an operating force, in other words, while the operating member 10 is at the neutral position. In the examples of FIGS. 11A and 11B and FIGS. 11C1 to 11C3, the first magnetic substance 13 and the second magnetic substance 14 are iron plates, and the third magnetic substance 15 is a permanent magnet. Alternatively, the third magnetic substance 15 may be a temporary magnet, such as an electromagnet.

When the operating member 10 is not receiving an operating force, the third magnetic substance 15 is attracted to each of the first magnetic substance 13 and the second magnetic substance 14, as illustrated in FIG. 11C1.

When the operating member 10 receives a clockwise operating force (in the direction indicated by arrow AR51), the second magnetic substance 14 attached to the operating member 10 serving as the movable member is separated from the third magnetic substance 15 and pivots clockwise together with the operating member 10, as illustrated in FIG. 11C2. The third magnetic substance 15 does not move while remaining attracted to the first magnetic substance 13 attached to the casing 12 serving as the fixing member.

When the operating member 10 receives a counterclockwise operating force (in the direction indicated by arrow AR52), the second magnetic substance 14 pivots counterclockwise together with the operating member 10 to push and move the third magnetic substance 15 counterclockwise, as illustrated in FIG. 11C3. As a result, the third magnetic substance 15 is separated from the first magnetic substance 13 and moves counterclockwise together with the second magnetic substance 14.

Thus, even if the operating member 10 is operated not linearly but pivotally, the input apparatus 100G can implement the same function as the function of the input apparatus 100 using the three magnetic substances. In other words, when a rightward pivoting operation is performed, the first switch (not illustrated) can be brought to on-state, and when a leftward pivoting operation is performed, the second switch (not illustrated) can be brought to on-state. On that basis, when neither a rightward pivoting operation nor a leftward pivoting operation is performed, the input apparatus 100G brings the first switch and the second switch to off-state and makes the third magnetic substance 15 attracted to each of the first magnetic substance 13 and the second magnetic substance 14, thereby preventing or reducing wobbling of the movable member more assuredly.

As described above, the input apparatus 100 (hereinafter including the input apparatuses 100A to 100G) according to the embodiments of the present invention includes the operating member 10 serving as a movable member that receives an operating force, the casing 12 serving as a fixing member that holds the operating member 10 so as to move in a plurality of operating directions, the first switch 21 and the second switch 22 that are switched between on-state and off-state by the movement of the operating member 10, the first magnetic substance 13 attached to the casing 12, the second magnetic substance 14 that moves together with the operating member 10, and the third magnetic substance 15 disposed so as to come into contact with each of the first magnetic substance 13 and the second magnetic substance 14 when the operating member 10 is not receiving an operating force and to come into contact with one of the first magnetic substance 13 and the second magnetic substance 14 when the operating member 10 is receiving an operating force. At least one of the first magnetic substance 13, the second magnetic substance 14, and the third magnetic substance 15 is a magnet. This configuration allows the input apparatus 100 to prevent or reduce wobbling of the operating member 10 when the operating member 10 is not receiving an operating force.

Furthermore, this configuration allows the magnetic force of the magnet forming at least one of the first magnetic substance 13, the second magnetic substance 14, and the third magnetic substance 15 to function as the pretension of each of the first switch 21 and the second switch 22. This allows adjusting the magnitude of the pretension by adjusting the magnetic force of the magnet. This configuration also allows the magnetic force of the magnet to function as a force for interfering with the operation of the input apparatus 100. The magnitude of an operating load (a force necessary for operating the operating member 10) can therefore be adjusted by adjusting the magnetic force of the magnet.

The third magnetic substance 15 is preferably disposed between the slide member 11 serving as the movable member and the casing 12 serving as the fixing member. The contact surface CS1 between the first magnetic substance 13 and the third magnetic substance 15 and the contact surface CS2 between the second magnetic substance 14 and the third magnetic substance 15 are substantially flush with each other. With this configuration, the second magnetic substance 14 is disposed inside the through-hole of the first magnetic substance 13, as illustrated in FIG. 2, for example. This can increase the space efficiency of the arrangement of the first magnetic substance 13, the second magnetic substance 14, and the third magnetic substance 15. In other words, the first magnetic substance 13, the second magnetic substance 14, and the third magnetic substance 15 can be housed compactly in a narrow space. This allows the size reduction of the input apparatus 100. The first magnetic substance 13, the second magnetic substance 14, and the third magnetic substance 15 can be manufactured at a low cost by pressing a simple iron plate or the like.

An example of the magnet forming at least one of the first magnetic substance 13, the second magnetic substance 14, and the third magnetic substance 15 is a ring-shaped magnet magnetized so as to have different magnetic poles along the moving direction of the movable member. Specifically, the magnet is a ring-shaped permanent magnet magnetized so as to have different magnetic poles in the Z-axis direction, as illustrated in FIG. 1B. More specifically, the permanent magnet is a plastic magnet, which is an axial anisotropic magnet and is formed of neodymium and ferrite. The permanent magnet therefore has a larger magnetic force than a ferrite plastic magnet and can be manufactured at a lower cost than a neodymium plastic magnet. This configuration allows the input apparatus 100 to prevent wobbling of the operating member 10 when the operating member 10 is not receiving an operating force even using an easy-to-magnetize low-price magnet. Alternatively, the magnet forming at least one of the first magnetic substance 13, the second magnetic substance 14, and the third magnetic substance 15 may be a temporary magnet, such as an electromagnet. In this case, the temporary magnet may be configured to have different magnetic poles in the moving direction of the movable member.

In the present embodiment, "the moving direction of the movable member" is equal to the operating direction. Specifically, the moving direction of the slide member 11 is equal to the moving direction of the operating member 10 along the operating direction. Alternatively, "the moving direction of the movable member" may differ from the operating direction. For example, the moving direction of the slide member 11 may be a direction different from the moving direction of the operating member 10. Specifically, the moving direction of the operating member 10 that is equal to the operating direction may be converted to another direction via a direction conversion mechanism, such as a link mechanism. In this case, the slide member 11 moves in a direction different from the moving direction of the operating member 10, in other words, a direction different from the operating direction.

An elastic sheet may be disposed between the third magnetic substance 15 and at least one of the first magnetic substance 13 and the second magnetic substance 14. This configuration allows the input apparatus 100 to reduce noise due to a collision between the magnetic substances when the pushing operation or the pulling operation is stopped, so that the operating member 10 returns to the neutral position.

The input apparatus 100 preferably includes a dome-like member serving as an urging member configured to return the operating member 10 to the neutral position, which is a position when the operating member 10 is not receiving an operating force. Specifically, the input apparatus 100 includes a first dome-like member 20*e* configured, when a pushing operation is stopped, to return the operating member 10 to the neutral position, and a second dome-like member 20*f* configured, when a pulling operation is stopped, to return the operating member 10 to the neutral position. This configuration allows the input apparatus 100 to use a magnet having a lower magnetic force, in other word, a lower-price magnet, as the urging force of the urging member is larger. This is because the restoration of the operating member 10 is assisted by the urging member even without the attracting force of the magnet, so that, when the pushing operation or the pulling operation is stopped, the operating member 10 can be returned to the neutral position more assuredly.

Thus, preferable embodiments of the present invention have been described. However, the present invention is not limited to the above embodiments. It is to be understood that various modifications and replacements can be made in the above embodiments without departing from the scope of the present invention. The features described with reference to the above embodiments may be combined as appropriate unless there is a technical contradiction.

For example, in the above embodiments, the switch mechanism 20 is configured, using the switch actuator 20*a*, when a pushing operation is performed, to turn on the first switch 21 and, when a pulling operation is performed, to turn on the second switch 22. Alternatively, the switch mechanism 20 may include a push-pull switch in which two movable contacts and one or two fixed contacts are arranged along the vertical axis.

Although the above embodiments use a dome-like member as the urging member, another member, such as a compression spring, may be employed as the urging member.

Figure 12:
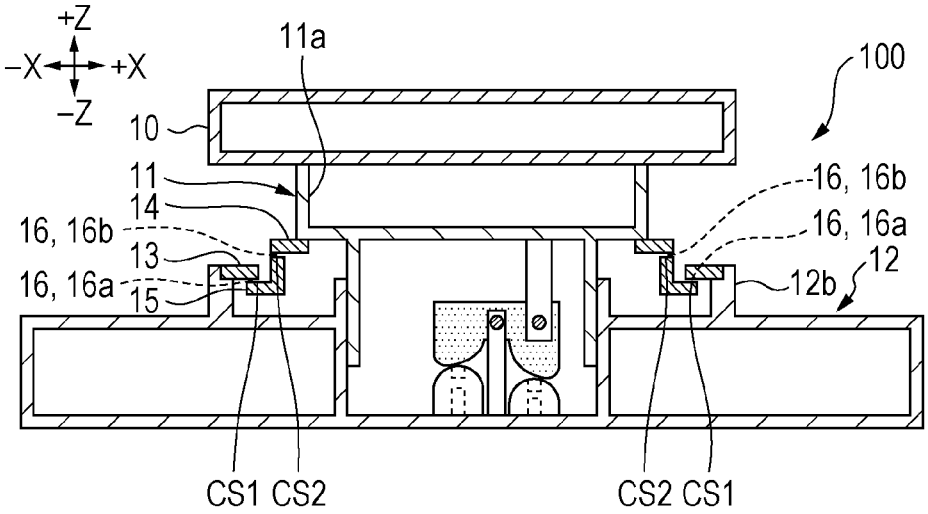
FIG. 12 is a cross-sectional view of still another configuration example of the input apparatus.

The above embodiments are configured such that the contact surface CS1 between the first magnetic substance 13 and the third magnetic substance 15 and the contact surface CS2 between the second magnetic substance 14 and the third magnetic substance 15 are substantially flush with each other. Alternatively, the contact surface CS1 may be located at a height different from the height of the contact surface CS2 (in the Z-axis direction), as illustrated in FIG. 12. In the example of FIG. 12, an elastic sheet 16 is bonded to the contact surface CS1 and the contact surface CS2. Specifically, an elastic sheet 16*a* is bonded to the lower surface of the first magnetic substance 13, and an elastic sheet 16*b* is bonded to the lower surface of the second magnetic substance 14.

Figure 13:
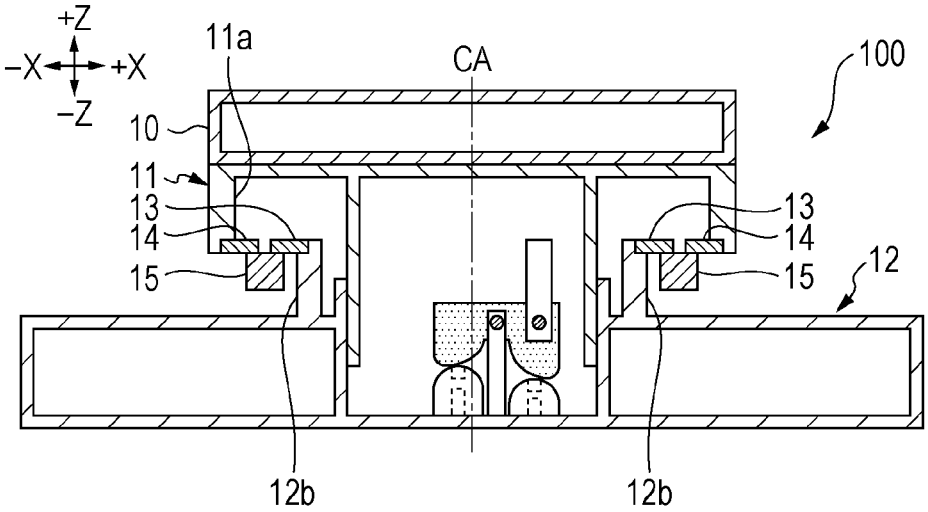
FIG. 13 is a cross-sectional view of still another configuration example of the input apparatus.

In the above embodiments, the first magnetic substance 13 attached to the fixing member is disposed outside the second magnetic substance 14 which moves together with the movable member in the radial direction of a circle centered on the axis CA. However, the first magnetic substance 13 may be disposed inside the second magnetic substance 14 in the radial direction of a circle centered on the axis CA, as illustrated in FIG. 13. In the example of FIG. 13, the first magnetic substance 13 is fitted to the upper end of the supporting portion 12*b* of the casing 12. The second magnetic substance 14 is fitted to the lower end of the joint portion 11*a* of the slide member 11 disposed radially outside the supporting portion 12*b*.

What is claimed is:

1. An input apparatus comprising:

a movable member that receives an operating force, the movable member being movable in a first operating direction and a second operating direction from a neutral position, the movable member being at the neutral position when the movable member does not receive the operating force;

a fixing member to which the movable member is movably supported;

a switch that switches between on-state and off-state as the movable member moves;

a first magnetic substance attached to the fixing member;

a second magnetic substance that moves together with the movable member; and a third magnetic substance disposed so as to come into contact with each of the first magnetic substance and the second magnetic substance in a state in which the movable member is at the neutral position, so as to come into contact with one of the first magnetic substance and the second magnetic substance in a state in which the movable member receives the operating force in the first operating direction, and so as to come into contact with the other of the first magnetic substance and the second magnetic substance in a state in which the movable member receives the operating force in the second operating direction, wherein at least one of the first magnetic substance, the second magnetic substance, and the third magnetic substance is a magnet.

2. The input apparatus according to claim 1, wherein the third magnetic substance is disposed between the movable member and the fixing member, and wherein a contact surface between the first magnetic substance and the third magnetic substance and a contact surface between the second magnetic substance and the third magnetic substance are substantially flush with each other.

3. The input apparatus according to claim 1, wherein the magnet is shaped like a ring and has different magnetic poles along a moving direction of the movable member.

4. The input apparatus according to claim 1, wherein an elastic sheet is disposed between the third magnetic substance and at least one of the first magnetic substance and the second magnetic substance.

5. The input apparatus according to claim 1, further comprising an urging member configured to return the movable member to the neutral position.

* * * * *